United States Patent [19]

Török et al.

[11] Patent Number: 5,077,500

[45] Date of Patent: Dec. 31, 1991

[54] AIR TRANSPORTING ARRANGEMENT

[75] Inventors: Vilmos Török, Lidingö ; Andrzej Loreth, Åkersberga, both of Sweden

[73] Assignee: Astra-Vent AB, Stockholm, Sweden

[21] Appl. No.: 382,701

[22] PCT Filed: Feb. 4, 1988

[86] PCT No.: PCT/SE88/00038

§ 371 Date: Aug. 7, 1989

§ 102(e) Date: Aug. 7, 1989

[87] PCT Pub. No.: WO88/05972

PCT Pub. Date: Aug. 11, 1988

[30] Foreign Application Priority Data

Feb. 5, 1987 [SE] Sweden ..... 8700441

[51] Int. Cl.[5] ..... H01J 7/24; H01T 23/00

[52] U.S. Cl. ..... 315/111.91; 250/324; 361/230; 361/231

[58] Field of Search ..... 315/111.81, 111.91; 250/423 R, 431, 324; 361/230, 231, 213

[56] References Cited

U.S. PATENT DOCUMENTS

| | | | |
|---|---|---|---|
| 2,279,586 | 4/1942 | Bennett | 315/111.91 |
| 2,765,975 | 10/1956 | Lindenblad | 315/111.91 |
| 4,380,720 | 4/1983 | Fleck | 315/111.91 |
| 4,812,711 | 3/1989 | Török et al. | 315/111.91 |

FOREIGN PATENT DOCUMENTS 2162697 2/1986 United Kingdom .

*Primary Examiner*—Eugene R. LaRoche

*Assistant Examiner*—Do Hyun Yoo

*Attorney, Agent, or Firm*—Browdy and Neimark

[57] ABSTRACT

An arrangement for transporting air with the aid of so-called electric ion wind with an air flow duct (1) in which a corona electrode (K) and a target electrode (M) are arranged in mutually axial spaced relationship, with the target electrode located downstream of the corona electrode. The corona electrode and the target electrode are each connected to a respective terminal of a d.c. voltage source (3), the voltage of which is such as to engender an air-ion generating corona discharge at the corona electrode. Arranged opposite the corona electrode on, or closely adjacent the wall of the air flow duct (1) are electrically conductive surfaces (4), which are connected to a potential which lies between the potential of the corona electrode (K) and the potential of the target electrode (M) and which is selected so that the potential difference between the electrically conductive surfaces (4) and the corona electrode (K) is as large as possible without any substantial part of the corona current passing to the surfaces (4). When the corona electrode has a plurality of mutually parallel and mutually adjacent wire-like electrode elements, further electrically conductive surfaces (5) may be provided between mutually adjacent wire-like electrode elements of the corona electrodes. These further electrically conductive surfaces (5) are electrically connected to the first mentioned electrically conductive surfaces (4) and extend parallel with the electrode elements and with the longitudinal extension of the duct (1).

5 Claims, 2 Drawing Sheets

AIR TRANSPORTING ARRANGEMENT

BACKGROUND OF THE INVENTION

The present invention relates to an arrangement for transporting air with the aid of so-called ion wind or corona wind.

In principle such an arrangement will include an air flow duct and a corona electrode and a target electrode which are arranged axially spaced from one another in the air flow duct, with the target electrode located downstream of the corona electrode as seen in the desired direction of air flow. Each of the corona electrode and target electrode is connected to a respective terminal of a d.c. voltage source, and the configuration of the corona electrode and the potential difference and distance between corona electrode and target electrode are such as to produce a corona discharge at the corona electrode. This corona discharge gives rise to air ions of the same polarity as the polarity of the corona electrode, and possibly also to electrically charged particles, so-called aerosols, i.e. solid particles or liquid droplets which are present in the air and which are charged electrically by collision with the charged air ions. The air ions migrate rapidly from the corona electrode to the target electrode, under the influence of the electric field, and relinquish their electric charge to the target electrode and return to electrically neutral air molecules. During their passage between respective electrodes, the air ions collide constantly with the electrically neutral air molecules, thereby transferring the electrostatic forces to these latter molecules so that said molecules are also drawn in a direction from the corona electrode to the target electrode, thereby transporting air in the form of a so-called ion wind or corona wind through the air flow duct.

Advantageous embodiments of such air transporting arrangements are described and illustrated in the international patent application PCT/SE85/00538 now U.S. Pat. No. 4,812,711 of Torok et al, issued Mar. 14, 1989.

In air transporting arrangements of this kind it is advantageous, from many aspects, for the corona electrode to be configured in the form of a wire-like electrode element or in the form of a plurality of wire-like electrode elements which are arranged in mutually parallel, adjacent relationship, these wire-like electrode elements being extended across the air flow duct. In this case, the air flow duct will have a rectangular or square cross-sectional shape with two mutually opposing walls which extend parallel with the wire-like corona-electrode elements, and two further walls in which the ends of the wire-like corona-electrode elements are attached in some suitable manner. The number of wire-like electrode elements used in this regard is determined primarily by the width of the air flow duct in a direction perpendicular to the longitudinal extension of the electrode elements, and consequently only a single wire-like electrode element is required in the case of narrow air flow ducts, whereas a wider airflow duct is preferably provided with a multiple of mutually parallel and mutually adjacent wire-like electrode elements.

Certain troublesome problems have been encountered, however, when using a corona electrode which comprises such wire-like electrode elements. As disclosed in the aforementioned international patent application, the efficiency in which the air is transported is directly dependent on the product of the strength of the ion current, i.e. the corona current, and the distance between the corona electrode and target electrode. Furthermore, the ion current should be distributed as uniformly as possible over the whole cross-sectional area of the air flow duct. In the case of a corona electrode which consists of one or more wire-like electrode elements arranged in the aforedescribed manner, it has been found, however, that the duct walls, which normally have an electrically insulated inner surface and an electrically earthed outer surface, and the electrode element attachment means located in said duct walls have a highly significant disturbing effect on the corona discharge which occurs in the proximity of the wire-like electrode elements, and therewith also a significant disturbing influence on the corona current. This screening and disturbing effect necessitates the use of a higher voltage between the corona and target electrodes in order to achieve the corona current desired, and results in uneven distribution of the corona discharge, and therewith the corona current, along the lengths of respective wire-like electrode elements and between the various electrode elements in that case when a plurality of electrode elements are arranged in mutually parallel, side-by-side relationship. When the air transporting arrangement comprises a plurality of mutually parallel and mutually adjacent wire-like electrode elements, these elements will not work under the same conditions, since the outermost electric elements have on one side thereof a wall of the air flow duct, whereas the remaining electrode elements have another wire-like electrode element on either side thereof. It has been found in the case of such arrangements that the various electrode elements are liable to exhibit extreme differences in corona discharge values.

SUMMARY OF THE INVENTION

The object of the present invention is to provide an air transporting arrangement of the aforedescribed kind, in which the aforediscussed problem is eliminated or at least substantially reduced, so that the distribution of the corona current is significantly more uniform and so that a corona current of desired value can be maintained with a lower voltage difference between the corona and the target electrodes.

This object is achieved in accordance with the invention by means of an air transporting arrangement constructed in accordance with the following claims.

BRIEF DESCRIPTION OF THE DRAWINGS

The invention will now be described in more detail with reference to exemplifying embodiments thereof and with reference to the accompanying drawings, in which.

DETAILED DESCRIPTION OF THE PREFERRED EMBODIMENT

Figure 1:
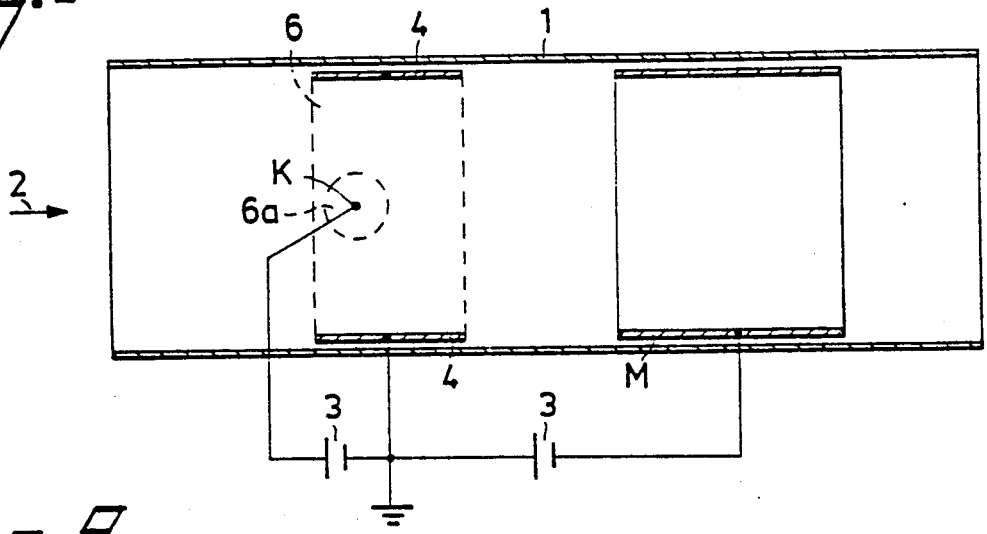
FIGS. 1 and 2 illustrate schematically mutually perpendicular axial sectional views of a first embodiment of an arrangement according to the invention.
Figure 2:
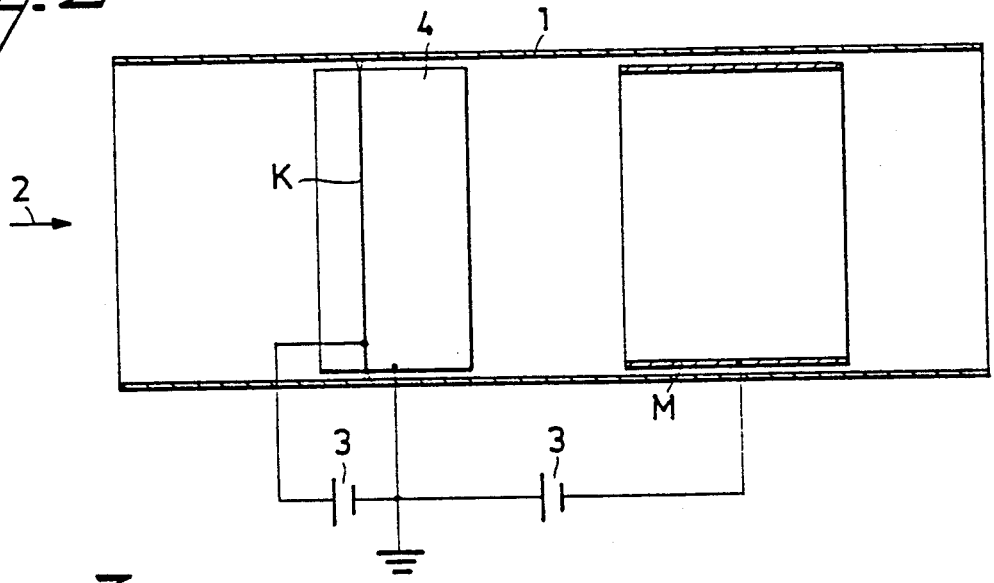

FIGS. 1 and 2 illustrate schematically, and by way of example, a first embodiment of an inventive air transporting arrangement, FIGS. 1 and 2 being mutually perpendicular axial sectional views of the inventive arrangement. The arrangement comprises an air flow duct 1 of rectangular cross-section, in which a corona electrode K and a target electrode M are arranged axially spaced from one another, with the target electrode M located downstream of the corona electrode K as seen in the desired air flow direction 2 through the duct. In the FIG. 1 embodiment, the corona electrode K is in the form of a single, straight thin wire which extends across the air flow duct 1, along the major axis in the rectangular cross-section of the duct, whereas the target electrode M consists of an electrically conducting surface or coating applied adjacent to or directly on the inner surface of the wall of said duct 1, and which extends around the whole circumference of said duct. The corona electrode K and the target electrode M are each connected to a respective terminal of a d.c. voltage source 3. The voltage of the voltage source 3 is such as to generate a corona discharge at the corona electrode K, this discharge in turn generating air ions which, under the influence of the electric field, migrate to the target electrode M, therewith generating an air flow 2 through the duct. The reader is referred to the aforesaid international patent application for a detailed description of the manner in which the air transporting arrangement operates. It shall be observed in this connection, however, that the target electrode may be configured in a number of different ways, as will be evident from the aforesaid international patent application and also from the Swedish patent application 8604219-9, and that the arrangement may optionally also include additional electrodes, such as screening electrodes and/or excitation electrodes, as described more specifically in said international patent application.

For the purpose of eliminating, or at least substantially reducing the disturbing and screening effect of the duct walls and the electrode attachments on said walls on the functioning of the corona electrode K, electrically conductive surfaces 4 are, in accordance with the invention, arranged opposite the corona electrode K on, or closely adjacent to the side walls of the duct 1 extending parallel with the longitudinal extension of the corona electrode K. These electrically conductive surfaces 4 are connected to an electrical potential lying between the potential of the corona electrode K and the potential of the target electrode M, the potential of the surfaces 4 being so selected in relation to the potentials of the corona electrode K and the target electrode M that the potential difference between the surfaces 4 and the corona electrode K is as large as possible without the surfaces 4 taking up any appreciable part of the corona current from the corona electrode K. The surfaces 4 shall be located opposite the corona electrode K and extend axially slightly upstream of the electrode and primarily slightly downstream thereof. The surfaces 4 may, in principle, extend upstream of the corona electrode K up to the location at which the air flow duct 1 commences, since the potential of the surfaces 4 is such that the surfaces will not take up any corona current and consequently are unable to cause undesired ion current in a direction upstream, away from the corona electrode K. Although the surfaces 4 may extend through a considerable distance downstream of the corona electrode K, they should not extend too close to the target electrode M, since such close proximity of the surfaces might give rise to insulation problems between the target electrode M and the surfaces 4, as will be readily understood. The surfaces 4 can be extended downstream of the corona electrode K through a distance corresponding to approximately 20–30% of the axial distance between the corona electrode K and the target electrode M. The surfaces 4 eliminate, or at least reduce substantially, the disturbing effect that the dielectric inner surface of the duct walls has on the functioning of the corona electrode K so that the desired corona discharge and therewith the desired corona current can be obtained with a lower voltage between the corona electrode and the target electrode than would otherwise be the case with the same electrode configuration in the absence of such surfaces, and so that the corona discharge is distributed more uniformly across the whole length of the wire-like corona electrode K. As before mentioned, the potential difference between the corona electrode K and the surfaces 4 should be as large as possible since this will afford the best result. This potential difference, however, should not be of such large magnitude as to cause any appreciable part of the corona current from the corona electrode K to flow to the surfaces 4. This would namely reduce the ion current to the target electrode M and therewith also reduce the extent to which air is transported through the duct 1, and would also cause the surfaces 4 to be contaminated with aerosols, particles or liquid droplets present in the air and electrically charged by the air ions generated through the corona discharge.

The electrically conductive surfaces 4 of the illustrated embodiment are connected to earth, which is advantageous from several aspects. Thus, in this case, the potential of the corona electrode K and the potential of the target electrode M are adapted in relation to earth, so as to establish the desired potential difference between corona electrode and target electrode and so that the potential difference between the corona electrode K and the electrically conductive surfaces fulfills the aforesaid conditions. It will be observed, however, that it is not at all necessary for the electrically conductive surfaces 4 to be connected to earth potential. An advantage is afforded when the outer surfaces of the airflow duct 1 are provided with an earthed electrically conductive coating, so that the arrangement can be touched safely.

When the surfaces 4 are referred to as being electrically conductive, the words "electrically conductive" shall be interpreted in the light of the fact that these surfaces conduct practically no current and hence their electrical conductivity can be very low. Thus, the surfaces 4 may comprise a material which is generally referred to as semi-conductive material, or may even comprise so-called antistatic material, i.e. a very highly resistive material, the use of which may be of particular interest when solely the corona electrode is connected to high voltage whereas the target electrode is earthed.

When the corona electrode incorporated in an air transporting arrangement according to the invention comprises a plurality of mutually parallel and mutually adjacent wire-like electrode elements, as is often required when the air flow duct 1 is relatively wide in a direction perpendicular to the longitudinal extension of the wire-like electrodes, it is essential that all of the wire-like corona electrode elements work under substantially the same conditions, so that an essentially equally as large corona discharge and therewith corona current, is obtained from all corona electrodes. This can be achieved with the aid of further electrically conductive surfaces which are parallel with and electrically connected to the surfaces 4 and which are arranged between the wire-like electrode elements, e.g. as illustrated schematically in FIG. 3.

Figure 3:
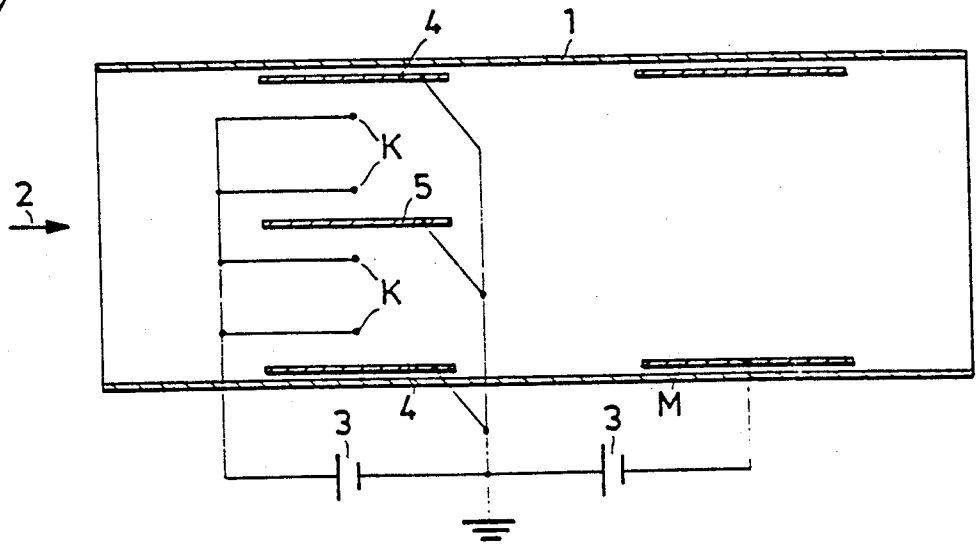
FIG. 3 is a schematic axial sectional view of a second embodiment of the invention.

FIG. 3 illustrates schematically an air transporting arrangement in which the corona electrode consists of four mutually parallel wire-like electrode elements K arranged in side-by-side relationship. The FIG. 3 embodiment also includes a further electrically conductive surface 5 which extends parallel with the surfaces 4 and which is connected electrically thereto, this further surface 5 being arranged centrally between the two centremost corona electrode elements K. This arrangement ensures that all wire-like corona electrode elements K will work under mutually the same conditions and will thus all engender mutually the same corona discharge and the same corona current values.

Figure 4:
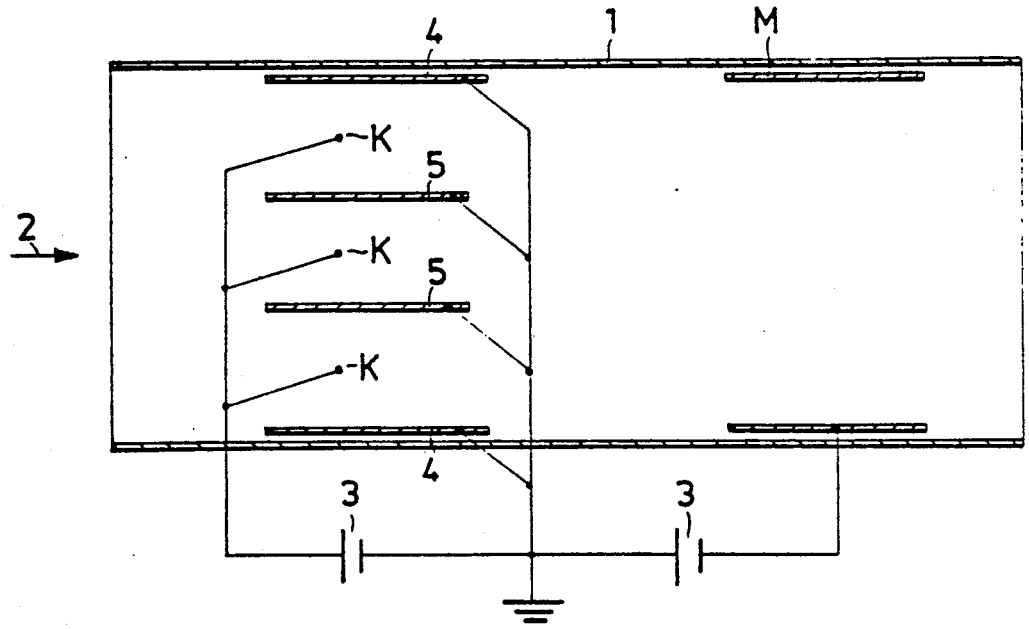
FIG. 4 is a schematic axial sectional view of a third embodiment of the invention.

As will be understood, the further electrically conductive surfaces 5 of the FIG. 3 embodiment could equally as well be arranged between all mutually adjacent corona electrode elements K, such that solely one wire-like electrode element K is located between two mutually adjacent electrically conductive surfaces 4 or 5. Such an arrangement will, of course, be necessary when an odd number of corona electrode elements K is used, as illustrated in FIG. 4, this Figure illustrating schematically and by way of example an air transporting arrangement which incorporates three wire-like corona electrode elements K.

An example is afforded when the duct walls extending perpendicular to the longitudinal extension of the respective wire-like corona electrode elements, i.e. the walls to which the ends of said elements K are attached, are provided with respective electrically conductive surfaces of the same kind as the surfaces 4 and connected to the same potential as said surfaces. Such an arrangement is illustrated schematically in FIG. 1 in which one such electrically conductive surface 6 is illustrated in broken lines. The surface 6 is provided with a recess or opening 6*a* which extends around the end of the corona electrode element K, i.e. around the means by which the electrode is attached to the duct wall, this recess or opening having a diameter such that substantially no current will pass from the corona electrode K to the surface 6. The provision of this further conductive surface 6 enables the conditions for the corona discharge at the ends of the corona electrode K to be further improved. This electrically conductive surface 6 may also be replaced with solely an annular electrically conductive surface which encircles the end of the wire-like corona electrode K at a suitable radial distance from said end.

Figure 5:
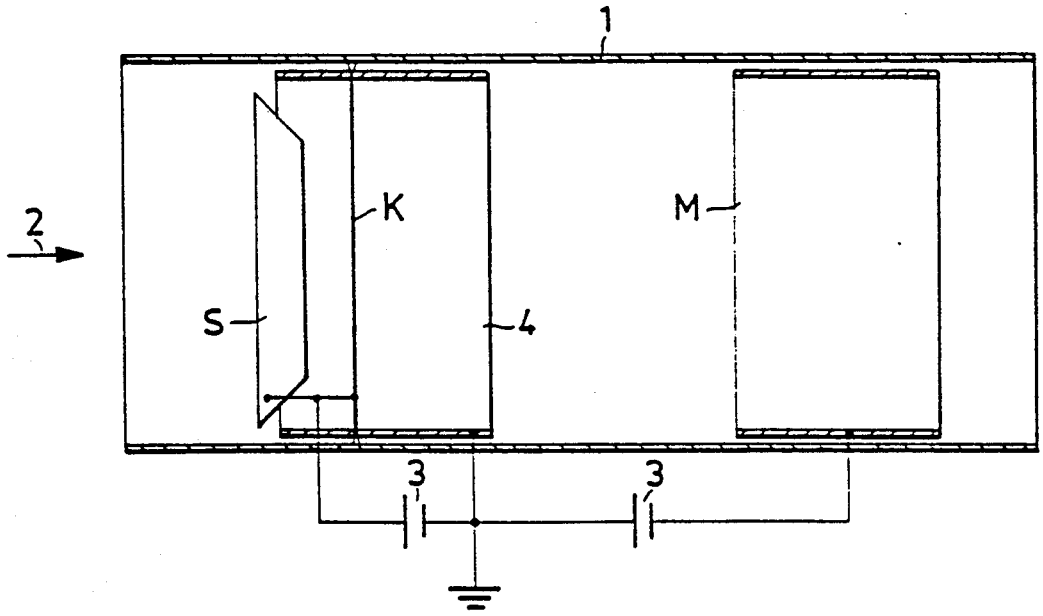
FIG. 5 is a schematic axial sectional view of a fourth embodiment of the invention.

As disclosed in the aforementioned international patent application, it is essential in air transporting arrangements of this kind to prevent an ion current from flowing in the upstream direction away from the corona electrode. Consequently, as disclosed in the international patent application, there may be provided upstream of the corona electrode a screening electrode which is connected to the same potential, or essentially the same potential as the corona electrode. As previously mentioned, when the corona electrode has the form of one or more wire-like electrode elements it is difficult to achieve a corona discharge, and therewith a corona current, which is distributed uniformly along the whole length of the wire-like electrode elements. There is, in this regard, a marked tendency for the corona discharge, and therewith the corona current, to diminish substantially, or even cease at the ends of the wire-like electrode elements. This drawback is counteracted to a significant extent by the electrically conductive surfaces 4 and 5 described in the aforegoing, although the problem still remains to some extent, despite the presence of said surfaces, when a screening electrode is located upsteam of the corona electrode. It has been found, however, that this problem can be totally eliminated, or at least very greatly reduced, when the screening electrode is configured in a manner such as to present a much smaller screening effect at the ends of the wire-like corona electrode elements. This can be achieved, for instance, in the manner illustrated schematically in FIG. 5. FIG. 5 illustrates an air transporting arrangement of the aforedescribed kind, comprising an air flow duct 1, a corona electrode K in the form of one or more wire-like electrode elements, a target electrode M and electrically conductive surfaces 4 located on or closely adjacent the inner surfaces of the duct side walls extending parallel with the longitudinal extensions of the corona electrode elements K and optionally also between the corona electrode elements K when the arrangement incorporates a plurality of such elements arranged in mutually parallel and mutually adjacent relationship. The arrangement of the FIG. 5 embodiment also includes a screening electrode S which is located upstream of the corona electrode K and connected to the same potential as said electrode, and which, in the illustrated embodiment, comprises a band-like strip of electrically conductive or semi-conductive material which is arranged axially centrally of the wire-like corona electrode element K, upstream thereof, and which extends parallel with said corona electrode element and with the direction of air flow. When the air transporting arrangement incorporates a multiple of wire-like corona electrode elements, one such screening electrode S will be located upstream of each corona electrode element. This screening electrode S will have a smaller screening effect at the ends of the wire-shaped corona electrode element K, either because no part of the screening electrode S is located opposite the ends of the electrode element K or because the screening electrode S is so configured that the distance between the screening electrode S and the electrode element K is greater at the ends of the electrode element than at its central portion.

It will be understood that the screening electrode may also be given other configurations which ensure that a smaller screening effect is obtained at the ends of a wire-like corona electrode than at its central portion, so as to obtain more uniform distribution of the corona discharge, and therewith more uniform distribution of the corona current along the whole length of the corona electrode.

We claim:

1. An arrangement for generating an air flow, with the aid of an electric ion wind, of a predetermined direction through an air flow duct with a rectangular cross-section and four duct walls, comprising a corona electrode consisting of at least two wire-like, mutually parallel electrode elements extending across said air flow duct substantially parallel to two mutually opposite duct walls and substantially in a common cross-sectional plane of the air flow duct; a target electrode located in the air flow duct axially spaced from and downstream of the corona electrode as seen in the direction of said air flow; a d.c. voltage source having one terminal connected to the corona electrode and another terminal connected to the target electrode, the distance and potential difference between corona electrode and target electrode being such that an air-ion generating corona discharge will occur at the corona electrode elements; and at the location of said corona electrode, first electrically conductive surfaces arranged closely adjacent inner surfaces of the mutually opposite duct walls which extend parallel with the wire-like electrode elements of the corona electrode, and other electrically conductive surfaces extending parallel with said first electrically conductive surfaces and located between said wire-like electrode elements of the corona electrode in a manner such that at most two corona electrode elements are located between each pair of two mutually adjacent first and other electrically conductive surfaces; and that said first as well as said other electrically conductive surfaces are connected to a common potential between a potential of the corona electrode and a potential of the target electrode.

2. An arrangement as claimed in claim 1, wherein additional electrically conductive surfaces are connected to said common potential and are provided closely adjacent the inner surfaces of the mutually opposite duct walls which extend perpendicular to the wire-like electrode elements of the corona electrode; said additional electrically conductive surfaces having a ring-shaped configuration and encircling the ends of the wire-like corona electrode elements at a distance therefrom.

3. An arrangement as claimed in claim 1, wherein said common potential is earth potential.

4. An arrangement as claimed in claim 1, wherein said first and other electrically conductive surfaces extend both upstream and downstream of said cross-sectional plane of the air flow duct containing said corona electrode.

5. An arrangement as claimed in claim 1, comprising a screening electrode arranged upstream of said corona electrode and connected to essentially the same potential as the corona electrode, said screening electrode being configured so as to exhibit a smaller screening effect at the ends of said wire-like electrode elements of the corona electrode than at the central portion of said electrode elements.

* * * * *